US010008143B2

(12) United States Patent
Park et al.

(10) Patent No.: US 10,008,143 B2
(45) Date of Patent: Jun. 26, 2018

(54) SCAN DRIVER

(71) Applicant: Samsung Display Co., Ltd., Yongin-si, Gyeonggi-do (KR)

(72) Inventors: Jun Hyun Park, Yongin-si (KR); Keum Nam Kim, Yongin-si (KR); Sung Hwan Kim, Yongin-si (KR); Kyoung Ju Shin, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1 day.

(21) Appl. No.: 15/092,466

(22) Filed: Apr. 6, 2016

(65) Prior Publication Data

US 2017/0061914 A1 Mar. 2, 2017

(30) Foreign Application Priority Data

Aug. 27, 2015 (KR) ..... 10-2015-0120996

(51) Int. Cl.
*G09G 5/00* (2006.01)
*G09G 3/20* (2006.01)

(52) U.S. Cl.
CPC ..... *G09G 3/20* (2013.01); *G09G 2310/0267* (2013.01); *G09G 2310/0286* (2013.01)

(58) Field of Classification Search
CPC . G09G 3/36; G09G 3/38; G11C 19/00; H03K 5/22
USPC ..... 345/204, 213
See application file for complete search history.

(56) References Cited

U.S. PATENT DOCUMENTS

2012/0170707 A1* 7/2012 Hsu ..... G09G 3/3677 377/79
2013/0335392 A1 12/2013 Cho et al.
2016/0012911 A1* 1/2016 Han ..... G09G 3/20 377/64
2016/0155422 A1* 6/2016 Sun ..... G09G 3/20 345/213
2016/0189586 A1* 6/2016 Zou ..... G09G 3/3266 345/213

(Continued)

*Primary Examiner* — Yuzhen Shen
(74) *Attorney, Agent, or Firm* — Lewis Roca Rothgerber Christie LLP

(57) ABSTRACT

In a scan driver including a plurality of stages configured to supply scan signals to scan lines, the scan driver includes: an i−1$^{th}$ stage configured to supply an i−1$^{th}$ scan signal to an i−1$^{th}$ scan line while controlling a node Qi−1 (i is a natural number) in response to a first clock signal, a third clock signal, and a control voltage; an i$^{th}$ stage configured to supply an i$^{th}$ scan signal to an i$^{th}$ scan line while controlling a node Qi in response to a second clock signal, a fourth clock signal, and the control voltage; and a controller connected to the i−1$^{th}$ stage and the i$^{th}$ stage, and configured to supply the control voltage.

15 Claims, 10 Drawing Sheets

(56) References Cited

U.S. PATENT DOCUMENTS

2016/0372041 A1* 12/2016 Sun ..... G09G 3/20
2017/0178557 A1* 6/2017 Li ..... G09G 3/2092

* cited by examiner

SCAN DRIVER

CROSS-REFERENCE TO RELATED APPLICATION

This application claims priority to and the benefit of Korean Patent Application No. 10-2015-0120996, filed on Aug. 27, 2015, in the Korean Intellectual Property Office, the content of which is incorporated herein by reference in its entirety.

BACKGROUND

1. Field

Embodiments of the present invention relate to a scan driver.

2. Description of the Related Art

According to development of information technology, the importance of a display device, which is a connection medium between a user and information, has increased. In line with this, the use of display devices, such as a Liquid Crystal Display Device (LCD) and an Organic Light Emitting Display Device (OLED), has increased.

In general, display devices include a data driver for supplying a data signal to data lines, a scan driver for supplying a scan signal to scan lines, and a pixel unit including pixels located in an area divided by the scan lines and the data lines.

The pixels included in the pixel unit are selected when a scan signal is supplied to the scan line and receives a data signal from the data line. The pixels receiving the data signal supply light with luminance corresponding to the data signal to the outside.

The scan driver includes stages connected to the scan lines. The stages supply the scan signal to the scan lines connected with the stages in response to the signals from the timing controller. To this end, each of the stages may be formed of a P-type (for example, a PMOS) and/or N-type (for example, NMOS) transistor, and may be mounted in a panel with the pixels at the same time.

Additionally, the stages mounted in the panel occupy a predetermined mounting area, which may limit the available space for mounting other components.

The above information disclosed in this Background section is only to enhance the understanding of the background of the invention, and therefore it may contain information that does not constitute prior art.

SUMMARY

Embodiments of the present invention relate to a scan driver, and a scan driver, of which a mounting area may be minimized or reduced.

Accordingly, some embodiments of the present invention include a scan driver for which a mounting area may be minimized or reduced.

According to some example embodiments of the present invention in a scan driver including a plurality of stages configured to supply scan signals to scan lines, the scan driver includes: an $i-1^{th}$ stage configured to supply an $i-1^{th}$ scan signal to an $i-1^{th}$ scan line while controlling a node Qi−1 (i is a natural number) in response to a first clock signal, a third clock signal, and a control voltage; an $i^{th}$ stage configured to supply an $i^{th}$ scan signal to an $i^{th}$ scan line while controlling a node Qi in response to a second clock signal, a fourth clock signal, and the control voltage; and a controller connected to the $i-1^{th}$ stage and the $i^{th}$ stage, and configured to supply the control voltage.

According to some embodiments, the first clock signal to the fourth clock signal are sequentially supplied so that high sections thereof do not overlap each other.

According to some embodiments, the controller comprises: a first transistor between a first input terminal configured to receive the second clock signal is supplied, and a first output terminal configured to output the control voltage; a second transistor between a gate electrode of the first transistor and the first input terminal, and comprising a gate electrode connected to the first input terminal; and a first driver configured to control a voltage of the first output terminal in response to a voltage supplied from at least one of the $i-1^{th}$ stage or the $i^{th}$ stage.

According to some embodiments, the first driver includes: a third transistor between the gate electrode of the first transistor and a second power input terminal configured to receive a second off voltage, and comprising a gate electrode connected to a second input terminal electrically connected with the node Qi; and a fourth transistor between the first output terminal and the second power input terminal, and comprising a gate electrode connected to the second input terminal.

According to some embodiments, the first driver comprises: a third transistor between the gate electrode of the first transistor and a second power input terminal configured to receive a second off voltage, and configured to be turned on when the $i^{th}$ scan signal is supplied; and a fourth transistor between the first output terminal and the second power input terminal, and configured to be turned on when the $i-1^{th}$ scan signal is supplied.

According to some embodiments, the first driver further includes a fifth transistor between the first output terminal and a third input terminal to which the first clock signal is supplied, and comprises a gate electrode connected to the third input terminal.

According to some embodiments, the controller includes: a first transistor between a first input terminal configured to receive an $i+2^{th}$ scan signal and a first output terminal configured to output the control voltage, and comprising a gate electrode connected to the first input terminal; and a second transistor between the first output terminal and a second power input terminal configured to receive a second off voltage, and comprising a gate electrode connected to a second input terminal configured to receive an $i-2^{th}$ scan signal.

According to some embodiments, each of the $i-1^{th}$ stage and the $i^{th}$ stage includes: an output unit located between an $11^{th}$ input terminal and a first power input terminal configured to receive a first off voltage, and the output unit being configured to supply a scan signal to a second output terminal in response to a voltage of a first node and a $14^{th}$ input terminal configured to receive the control voltage; a pull-down unit connected to an $12^{th}$ input terminal and a second power input terminal configured to receive a second off voltage and configured to control a voltage of the first node; a pull-up unit between a $13^{th}$ input terminal and the first node, and configured to control a voltage of the first node; and a second driver connected to the first node, the second power input terminal, and the $14^{th}$ input terminal and configured to control a voltage of the first node.

According to some embodiments, the first off voltage and a second off voltage are set to the same voltage.

According to some embodiments, the second off voltage is set to a voltage lower than the first off voltage.

According to some embodiments, the first clock signal is supplied to an $11^{th}$ input terminal of the $i-1^{th}$ stage, the third clock signal is supplied to a $12^{th}$ input terminal of the $i-1^{th}$ stage, and an $i-2^{th}$ scan signal that is an output signal of a stage of a previous terminal is supplied to a $13^{th}$ input terminal of the $i-1^{th}$ stage, and the first node of the $i-1^{th}$ stage is the node Qi−1.

According to some embodiments, the second clock signal is supplied to an $11^{th}$ input terminal of the $i^{th}$ stage, the fourth clock signal is supplied to a $12^{th}$ input terminal of the $i^{th}$ stage, and an $i-1^{th}$ scan signal that is an output signal of a stage of a previous terminal is supplied to a $13^{th}$ input terminal of the $i^{th}$ stage, and the first node of the $i^{th}$ stage is the node Qi.

According to some embodiments, the pull-up unit comprises one or more $11^{th}$ transistors connected to the $13^{th}$ input terminal and the first node and comprise gate electrodes connected to the $13^{th}$ input terminal.

According to some embodiments, the pull-up unit comprises: an $11^{th}$ transistor between the $13^{th}$ input terminal and a second node, and comprising a gate electrode connected to the $13^{th}$ input terminal; a $12^{th}$ transistor between the second node and the first node, and comprising a gate electrode connected to the second node; and a $13^{th}$ transistor between the second node and the second output terminal, and comprising a gate electrode connected to the second output terminal.

According to some embodiments, the pull-up unit includes: an $11^{th}$ transistor between the $13^{th}$ input terminal and a second node, and turned on when an $i-2^{th}$ scan signal is supplied; a $12^{th}$ transistor between the second node and the first node, and comprising a gate electrode connected to the second node; and a $13^{th}$ transistor between the second node and the second output terminal, and comprising a gate electrode connected to the second output terminal.

According to some embodiments, when the first clock signal is supplied to the $11^{th}$ input terminal, the fourth clock signal is supplied to the $13^{th}$ input terminal, and when the second clock signal is supplied to the $11^{th}$ input terminal, the first clock signal is supplied to the $13^{th}$ input terminal.

According to some embodiments, the output unit includes: a $14^{th}$ transistor between the $11^{th}$ input terminal and the second output terminal, and comprising a gate electrode connected to the first node; a $15^{th}$ transistor between the second output terminal and the first power input terminal, and comprising a gate electrode connected to the $14^{th}$ input terminal; and a first capacitor between the first node and the second output terminal.

According to some embodiments, the pull-down unit includes one or more $16^{th}$ transistors which are serially connected between the first node and the second power input terminal and include gate electrodes connected to the $12^{th}$ input terminal.

According to some embodiments, the second driver includes one or more $17^{th}$ transistors between the first node and the second power input terminal and comprise gate electrodes connected to the $14^{th}$ input terminal.

According to the scan driver according to the example embodiment of the present invention, adjacent stages share the controller which stabilizes a voltage of the node Q, thereby minimizing or reducing a mounting area of the scan driver.

BRIEF DESCRIPTION OF THE DRAWINGS

Aspects of example embodiments of the present invention will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
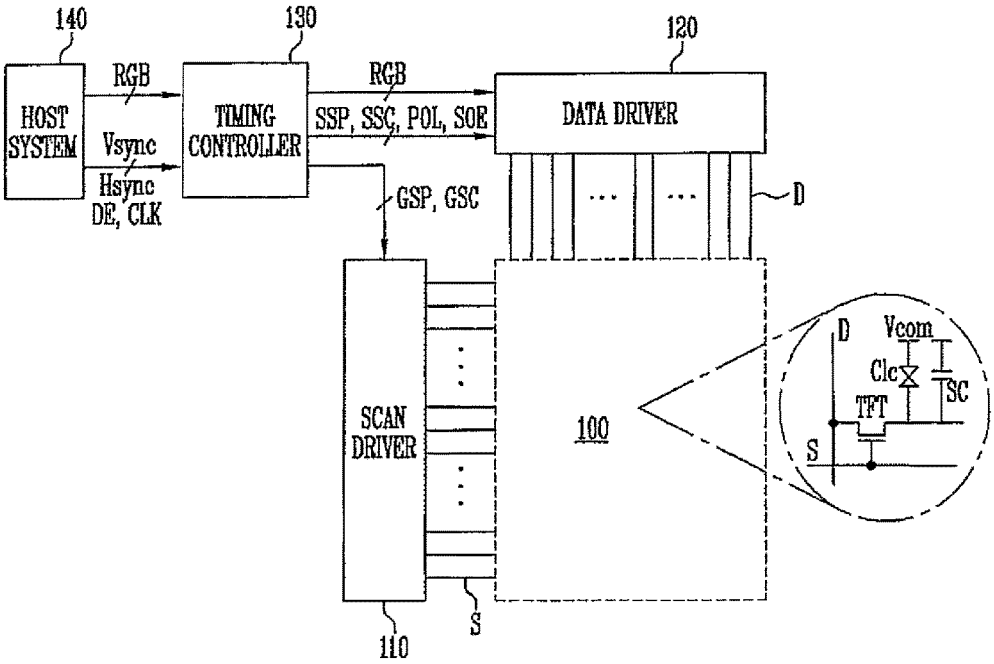
FIG. 1 is a block diagram schematically illustrating a display device according to an example embodiment of the present invention.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram schematically illustrating a display device according to an example embodiment of the present invention. For convenience of the description, it is assumed in FIG. 1 that a display device is a liquid crystal display, but the present invention is not limited thereto.

Referring to FIG. 1, the display device according to the example embodiment of the present invention includes a pixel unit 100, a scan driver 110, a data driver 120, a timing controller 130, and a host system 140.

The pixel unit 100 refers to an effective display unit of a liquid crystal panel. The liquid crystal panel includes a Thin Film Transistor (TFT) substrate and a color filter substrate. A liquid crystal is formed between the TFT substrate and the color filter substrate. Data lines D and scan lines S are formed on the TFT substrate, and a plurality of pixels is arranged in areas divided by the scan lines S and the data lines D.

The TFT included in each of the pixels transmits a voltage of a data signal supplied via the data line D in response to a scan signal from the scan line S to a liquid crystal capacitor Clc. To this end, a gate electrode of the TFT is connected to the scan line S and a first electrode thereof is connected to the data line D. Further, a second electrode of the TFT is connected to a liquid crystal capacitor Clc and a storage capacitor SC.

Here, the first electrode refers to any one of a source electrode and a drain electrode of the TFT, and the second electrode refers to a different electrode from the first electrode. For example, when the first electrode is set as the drain electrode, the second electrode is set as the source electrode. Further, the liquid crystal capacitor Clc is a capacitor equivalently expressing a liquid crystal between a pixel electrode and a common electrode formed on the TFT substrate. The storage capacitor SC maintains a voltage of a data signal transmitted to the pixel electrode until a next data signal is supplied.

A black matrix, a color filter, and the like are formed on the color filter substrate.

The common electrode is formed on the color filter substrate in a vertical field effect driving method, such as a Twisted Nematic (TN) mode and a Vertical Alignment (VA) mode, and is formed on the TFT substrate together with the pixel electrode in a horizontal field effect driving method, such as an In Plane Switching (IPS) mode and a Fringe Field Switching (FFS) mode. A common voltage Vcom is supplied to the common electrode. Further, a liquid crystal mode of the liquid crystal panel may include any kind of liquid crystal mode, as well as the aforementioned TN mode, VA mode, IPS mode, and FFS mode.

The data driver 120 converts image data RGB input from the timing controller 130 into a positive/negative gamma compensation voltage and generates positive/negative analog data voltages. The positive/negative analog data voltages generated by the data driver 120 are supplied to the data lines D as data signals.

Figure 2:
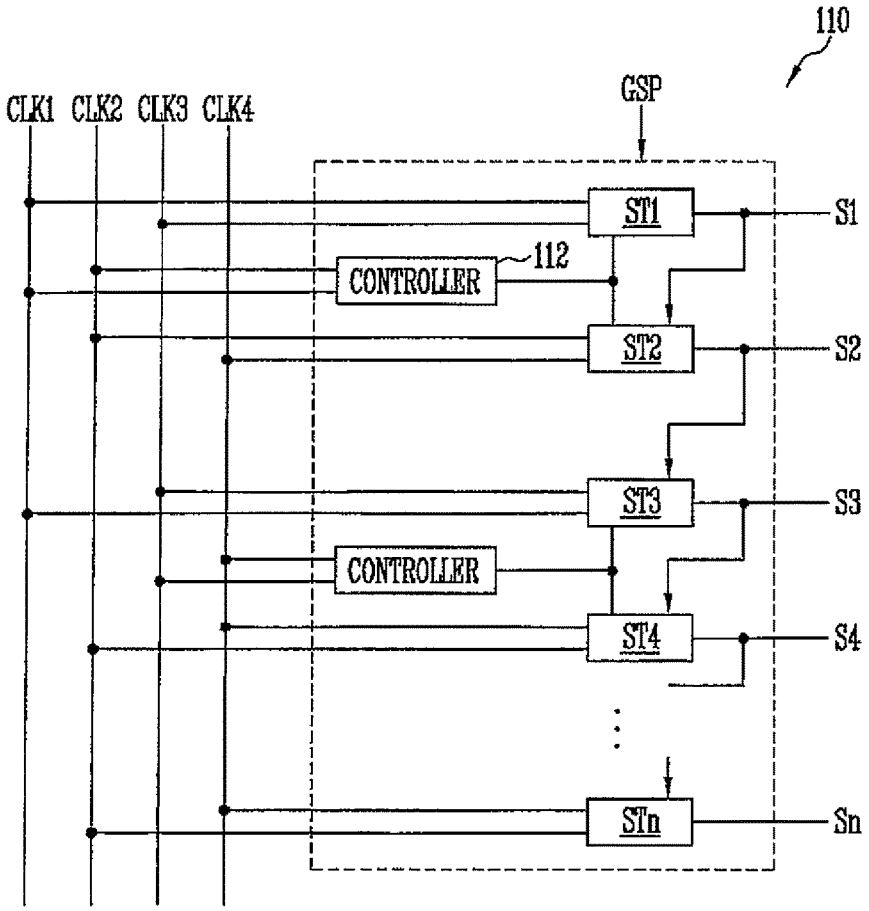
FIG. 2 is a diagram schematically illustrating a scan driver illustrated in FIG. 1.

The scan driver 110 supplies a scan signal to the scan lines S. For example, the scan driver 110 may sequentially supply a scan signal to the scan lines S. When the scan signal is sequentially supplied to the scan lines S, the pixels are selected in the unit of a horizontal line, and the pixels selected by the scan signal receive the data signal. To this end, the scan driver 110 includes stages ST connected to the scan lines S, respectively, as illustrated in FIG. 2. The scan driver 110 may be embedded in the liquid crystal panel in a form of an Amorphous Silicon Gate (ASG) driver. That is, the scan driver 110 may be embedded in the TFT Substrate through a thin film process. Further, the scan driver 110 may also be embedded at both sides of the liquid crystal panel with the pixel unit 100 interposed therebetween.

The timing controller 130 supplies a gate control signal to the scan driver 110, and supplies a data control signal to the data driver 120 based on timing signals, such as the image data RGB, a vertical synchronization signal Vsync, a horizontal synchronization signal Hsync, a data enable signal DE, and a clock signal CLK, output from the host system 140.

The gate control signal includes a Gate Start Pulse (GSP), one or more Gate Shift Clocks (GSC), and the like. The GSP controls a timing of the first scan signal. The GSC refers to one or more clock signals for shifting the GSP.

The data control signal includes a Source Start Pulse (SSP), a Source Sampling Clock (SSC), a Source Output Enable (SOE) signal, a Polarity Control (POL) signal, and the like. The SSP controls a start time of a data sampling of the data driver 120. The SSC controls a sampling operation of the data driver 120 based on a rising or falling edge. The SOE signal controls an output timing of the data driver 120. The POL signal reverses a polarity of a data signal output from the data driver 120.

The host system 140 supplies image data RGB to the timing controller 130 through an interface, such as Low Voltage Differential Signaling (LVDS), and Transition Minimized Differential Signaling (TMDS). Further, the host system 140 supplies timing signals Vsync, Hsync, DE, and CLK to the timing controller 130.

FIG. 2 is a diagram schematically illustrating the scan driver illustrated in FIG. 1.

Referring to FIG. 2, the scan driver 110 according to the example embodiment of the present invention includes a plurality of stages ST1 to STn, and a controller 120 for supplying a control voltage while sharing two adjacent stages ST.

Each of the stages ST1 to STn is connected to any one of the scan lines S1 to Sn, and supplies a scan signal to the scan lines S1 to Sn in response to the GSP. For example, an $i^{th}$ (i is a natural number) stage STi is connected to an $i^{th}$ scan line Si and supplies a scan signal to the $i^{th}$ scan line Si.

Each of the stages ST1 to STn receives two clock signals among a plurality of clock signals CLK1 to CLK4. For example, a first stage ST1 receives a first clock signal CLK1 and a third clock signal CLK3, and a second stage ST2 receives a second clock signal CLK2 and a fourth clock signal CLK4. Further, a third stage ST3 receives the third clock signal CLK3 and the first clock signal CLK1, and a fourth stage ST4 receives the fourth clock signal CLK4 and the second clock signal CLK2. Then, the aforementioned connection configuration of the first stage ST1 to the fourth stage ST4 may be arranged while being repeated on the stages ST.

Figure 8:
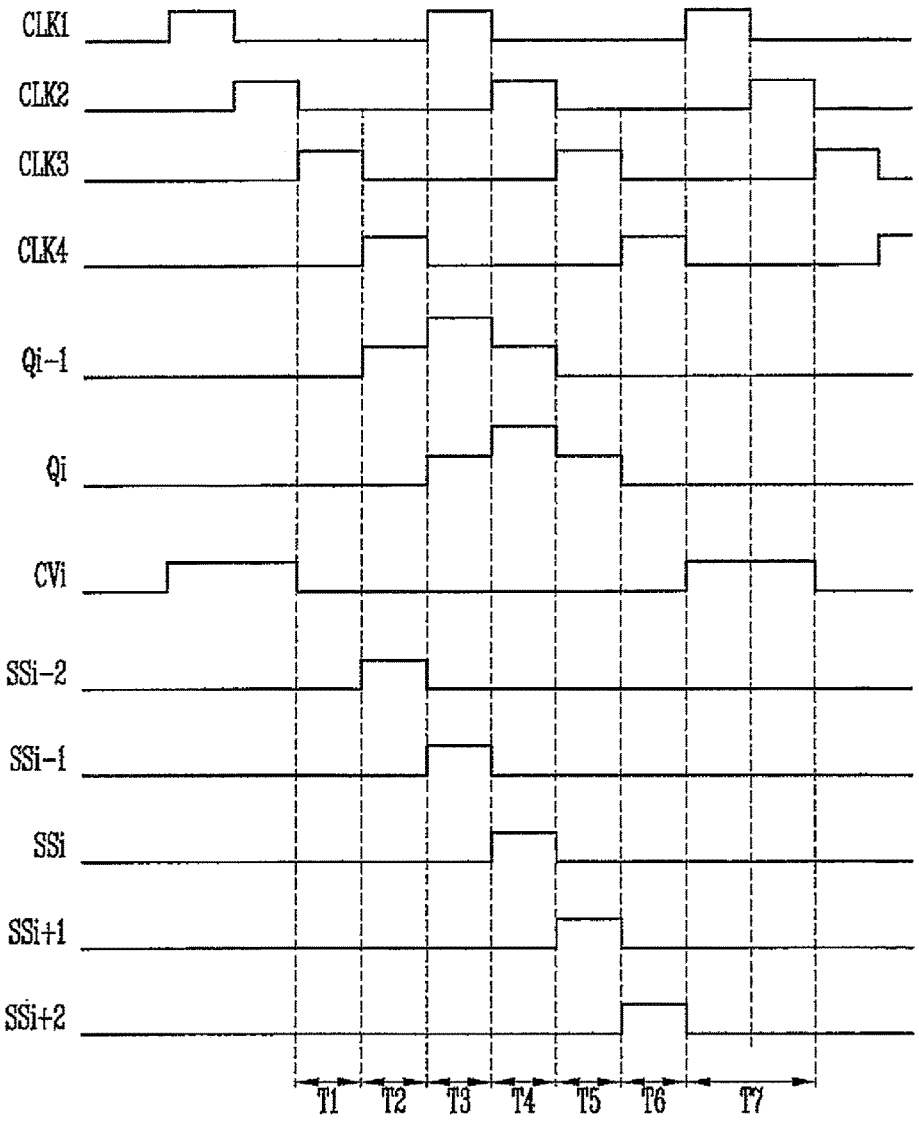
FIG. 8 is a diagram illustrating an example embodiment of an operation process of FIG. 7.

The first clock signal CLK1 to the fourth clock signal CLK4 are square wave signals repeating a high voltage (a high section) and a low voltage (low section) as illustrated in FIG. 8. Here, the high voltage is set as a gate-on voltage for turning on the transistors included in the stage ST, and the low voltage is set as a gate-off voltage for turning off the transistors included in the stage ST. Further, the first clock signal CLK1 to the fourth clock signal CLK4 are sequentially supplied so that the high sections thereof do not overlap.

The controller 112 is connected with the two adjacent stages ST. For example, the first stage ST1 and the second stage ST2 are commonly connected to the first controller 112, and the third stage ST3 and the fourth stage ST4 are commonly connected to the second controller 112. The controller 112 is used for controlling a Q node included in the stage ST.

Each of the controllers 112 receives two clock signals among the plurality of clock signals CLK1 to CLK4. For example, the first controller 112 receives the first clock signal CLK1 and the second clock signal CLK2, and the second controller 112 receives the third clock signal CLK3 and the fourth clock signal CLK4. Then, the controllers 112 may be arranged while repeating the aforementioned connection configuration of the first and second controllers 112.

In the meantime, when the two stages ST share one controller 112 as described above, a mounting area of the scan driver 110 may be minimized or reduced. Experimentally, when the two stages ST share one controller 112, it is possible to decrease a size of a bezel by about 20%.

Further, FIG. 2 illustrates only n stages ST1 to STn, but the present invention is not limited thereto. For example, the scan driver 110 may additionally include a plurality of dummy stages in order to secure stability of the driving.

Figure 3:
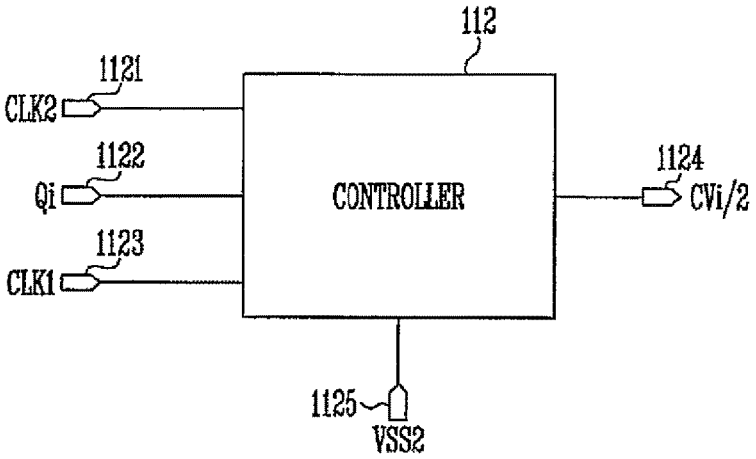
FIG. 3 is a diagram schematically illustrating terminals connected to a controller.

FIG. 3 is a diagram schematically illustrating terminals connected to the controller. FIG. 3 illustrates the controller connected to an $i-1^{th}$ stage STi−1 and the $i^{th}$ stage STi for convenience of the description.

Referring to FIG. 3, the controller 112 includes a first input terminal 1121, a second input terminal 1122, a third input terminal 1123, a first output terminal 1124, and a second power input terminal 1125.

The first input terminal 1121 receives the second clock signal CLK2.

The second input terminal 1122 receives a voltage of a Q node Qi of the $i^{th}$ stage.

The third input terminal 1123 receives the first clock signal CLK1.

The first output terminal 1124 supplies a control voltage CVi/2 to the i−1$^{th}$ stage STi−1 and the i$^{th}$ stage STi.

The second power input terminal 1125 receives a second off voltage VSS2. Here, the second off voltage VSS2 is set as a voltage, at which the transistors included in the controller 112 are turned off.

Additionally, the controller 112 connected to an i+1$^{th}$ stage ST1+1 and an i+2$^{th}$ stage STi+2 receives the fourth clock signal CLK4 through the first input terminal 1121, a voltage of a node Q Qi+2 of an i+2$^{th}$ stage through the second input terminal 1122, and the third clock signal CLK3 through the third input terminal 1123, and a configuration of the circuit is equally set.

Figure 4:
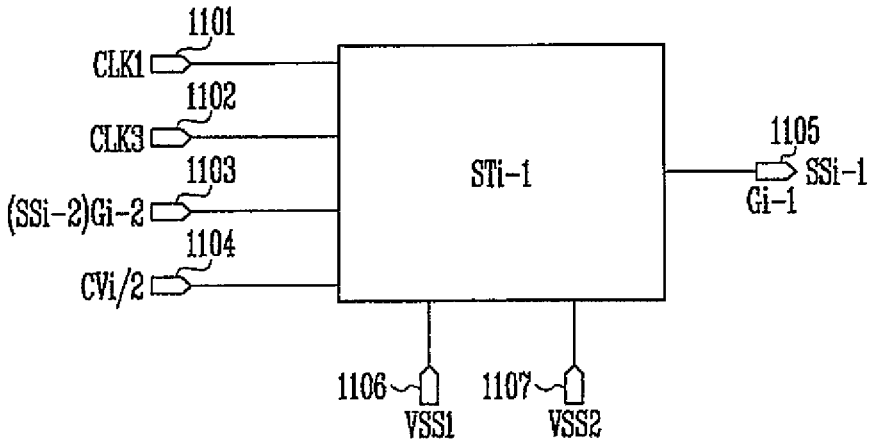
FIG. 4 is a diagram schematically illustrating terminals connected to a stage.

FIG. 4 is a diagram schematically illustrating the terminals connected to the stage. For convenience of the description, FIG. 4 illustrates the i−1$^{th}$ stage STi−1.

Referring to FIG. 4, the i−1$^{th}$ stage STi−1 includes an 11$^{th}$ input terminal 1101, a 12$^{th}$ input terminal 1102, a 13$^{th}$ input terminal 1103, a 14$^{th}$ input terminal 1104, a second output terminal 1105, a first power input terminal 1106, and a second power input terminal 1107.

The 11$^{th}$ input terminal 1101 receives the first clock signal CLK1.

The 12$^{th}$ input terminal 1102 receives the third clock signal CLK3.

The 13$^{th}$ input terminal 1103 receives an i−2$^{th}$ scan signal SSi−2 from an output terminal Gi−2 of a stage STi−2 of a previous stage.

The 14$^{th}$ input terminal 1104 receives the control voltage CVi/2 from the controller 112, to which the 14$^{th}$ input terminal 1104 is connected.

The second output terminal 1105 (or the output terminal Gi−1) supplies a scan signal SSi−1 of the i−1$^{th}$ stage STi−1 to the i−1$^{th}$ scan line Si−1 and a stage STi of the next stage.

The first power input terminal 1106 receives the first off voltage VSS1, and the second power input terminal 1107 receives the second off voltage VSS2. Here, the first off voltage VSS1 and the second off voltage VSS2 are set as voltages, at which the transistor included in the stage ST is turned off. Further, the second off voltage VSS2 is set as a voltage lower than the first off voltage VSS1. Additionally, according to some embodiments of the present invention, the first off voltage VSS1 and the second off voltage VSS2 are used for completely turning off the transistor, but the present invention is not limited thereto. For example, the second off voltage VSS2 may also be supplied to the first power input terminal 1126 and the second power input terminal 1127.

In the meantime, the stages, other than the i−1$^{th}$ stage STi−1, have the same configuration of the circuit, except for the clock signals supplied to the first input terminal 1101 and the second input terminal 1102 as illustrated in FIG. 2.

Figure 5:
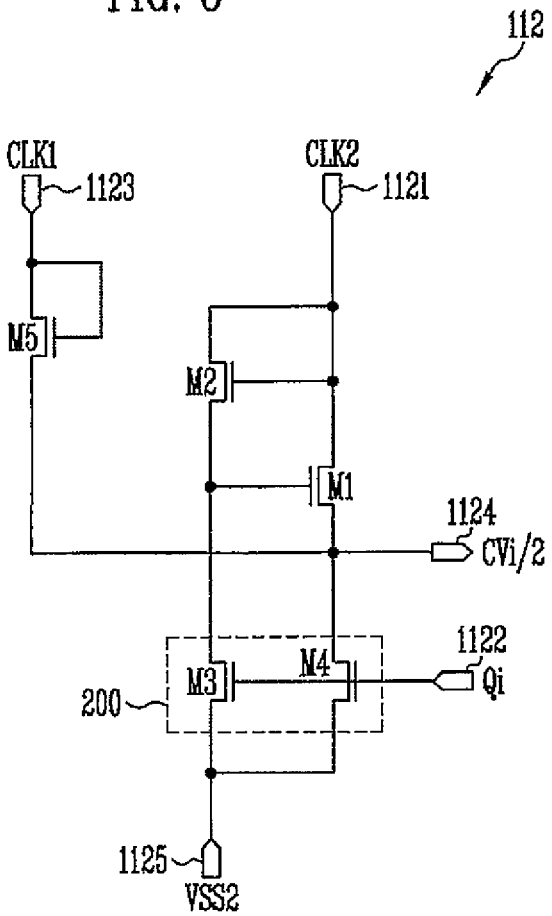
FIG. 5 is a diagram illustrating an example embodiment of the controller illustrated in FIG. 3.

FIG. 5 is a diagram illustrating an example embodiment of the controller illustrated in FIG. 3.

Referring to FIG. 5, the controller 112 according to the example embodiment of the present invention includes a first transistor M1, a second transistor M2, a fifth transistor M5, and a first driver 200.

The first transistor M1 is connected between the first input terminal 1121 and the first output terminal 1124. The first transistor M1 is turned on or turned off in response to a voltage of a gate electrode thereof. When the first transistor M1 is turned on, the first input terminal 1121 and the first output terminal 1124 are electrically connected.

The second transistor M2 is connected between the first input terminal 1121 and a gate electrode of the first transistor M1. Then, a gate electrode of the second transistor M2 is connected to the first input terminal 1121. That is, the second transistor M2 is connected to the first input terminal 1121 in a form of a diode so that a current may flow from the first input terminal 1121 to the gate electrode of the first transistor M1, and is turned on or turned off in response to a voltage of the first input terminal 1121.

The first driver 200 controls a voltage of the first output terminal 1124 in response to a voltage supplied from at least one of the i−1$^{th}$ stage STi−1 or the i$^{th}$ stage STi. For example, the first driver 200 controls a voltage of the first output terminal 1124 in response to a voltage of the node Q Qi of the i$^{th}$ stage STi. To this end, the first driver 200 includes the third transistor M3 and a fourth transistor M4.

The third transistor M3 is connected between the gate electrode of the first transistor M1 and the second power input terminal 1125. Further, a gate electrode of the third transistor M3 is connected to the second input terminal 1122. The third transistor M3 is turned on or turned off in response to a voltage of the second input terminal 1122.

The fourth transistor M4 is connected between the first output terminal 1124 and the second power input terminal 1125. Further, a gate electrode of the fourth transistor M4 is connected to the second input terminal 1122. The fourth transistor M4 is turned on or turned off in response to a voltage of the second input terminal 1122.

The fifth transistor M5 is connected between the third input terminal 1123 and the first output terminal 1124. Then, a gate electrode of the fifth transistor M5 is connected to the third input terminal 1123. That is, the fifth transistor M5 is connected to the third input terminal 1123 in a form of a diode so that a current may flow from the third input terminal 1123 to the first output terminal 1124, and is turned on or turned off in response to a voltage of the third input terminal 1123.

Figure 6:
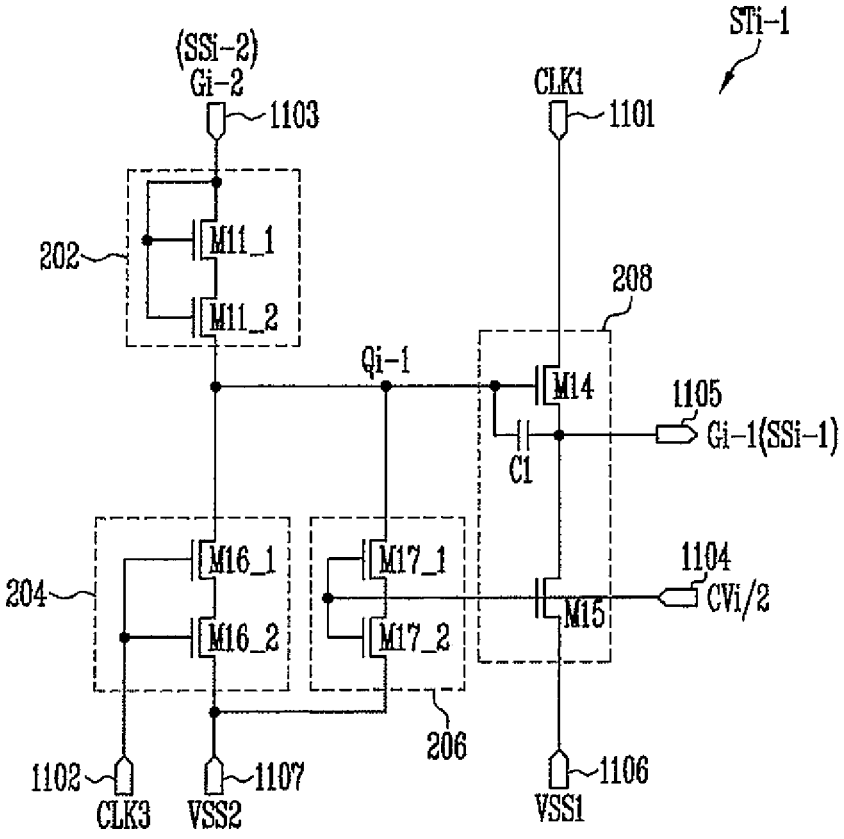
FIG. 6 is a diagram illustrating an example embodiment of the stage illustrated in FIG. 4.

FIG. 6 is a diagram illustrating an example embodiment of the stage illustrated in FIG. 4.

Referring to FIG. 6, the stage STi−1 according to the example embodiment of the present invention includes a pull-up unit 202, a pull-down unit 204, a second driver 206, and an output unit 208.

The pull-up unit 202 is connected between the 13$^{th}$ input terminal 1103 and the node Qi−1 (or the first node). The pull-up unit 202 controls a voltage of the node Qi−1 in response to an i−2$^{th}$ scan signal SSi−2 from an output terminal Gi−2 of the stage Sti−2 of the previous terminal supplied from the 13$^{th}$ input terminal 1103. To this end, the pull-up unit 202 includes a plurality of 11$^{th}$ transistors M11_1 and M11_2 connected between the 13$^{th}$ input terminal 1103 and the node Qi−1. Further, gate electrodes of the 11$^{th}$ transistors M11_1 and M11_2 are connected to the 13$^{th}$ input terminal 1103. That is, the 11$^{th}$ transistors M11_1 and M11_2 are connected to the 13$^{th}$ input terminal 1103 in a form of a diode so that a current may flow from the 13$^{th}$ input terminal 1103 to the node Qi−1, and is turned on or turned off in response to a voltage of the 13$^{th}$ input terminal 1103.

The output unit 208 outputs the scan signal SSi−1 to the second output terminal 1105 in response to the voltage supplied to the 11$^{th}$ input terminal 1101, the first power input terminal 1106, the node Qi−1, and the 14$^{th}$ input terminal 1104. To this end, the output unit 208 includes a 14$^{th}$ transistor M14 and a 15$^{th}$ transistor M15.

The 14$^{th}$ transistor M14 is connected between the 11$^{th}$ input terminal 1101 and the second output terminal 1105. Then, a gate electrode of the 14$^{th}$ transistor M14 is connected to the node Qi−1. The 14$^{th}$ transistor M14 controls the connection between the 11$^{th}$ input terminal 1101 and the second output terminal 1105 while being turned on or turned off in response to the voltage of the node Qi−1.

The 15$^{th}$ transistor M15 is connected between the second output terminal 1105 and the first power input terminal 1106. Further, a gate electrode of the 15$^{th}$ transistor M5 is connected to the 14$^{th}$ input terminal 1104. The 15$^{th}$ transistor M15 controls the connection between the second output terminal 1105 and the first power input terminal 1106 while being turned on or turned off in response to the control voltage CVi/2 supplied to the 14$^{th}$ input terminal 1104.

The pull-down unit 204 controls the voltage of the node Qi−1 in response to the voltage supplied to the 12$^{th}$ input terminal 1102 and the second power input terminal 1107. To this end, the pull-down unit 204 includes a plurality of 16$^{th}$ transistors M16_1 and M16_2 connected between the node Qi−1 and the second power input terminal 1107.

The 16$^{th}$ transistors M16_1 and M16_2 are connected between the node Qi−1 and the second power input terminal 1107, and gate electrodes thereof are connected to the 12$^{th}$ input terminal 1102. The 16$^{th}$ transistors M16_1 and M16_2 control the connection between the node Qi−1 and the second power input terminal 1107 while being turned on or turned off in response to a clock signal CLK3 supplied to the 12$^{th}$ input terminal 1102.

The second driver 206 controls the voltage of the node Qi−1 in response to the voltage supplied to the 14$^{th}$ input terminal 1104 and the second power input terminal 1107. To this end, the second driver 206 includes a plurality of 17$^{th}$ transistors M17_1 and M17_2.

The 17$^{th}$ transistors M17_1 and M17_2 are connected between the node Qi−1 and the second power input terminal 1107. Further, gate electrodes of the 17$^{th}$ transistors M17_1 and M17_2 are connected to the 14$^{th}$ input terminal 1104. The 17$^{th}$ transistors M17_1 and M17_2 control the connection between the node Qi−1 and the second power input terminal 1107 while being turned on or turned off in response to the control voltage CVi/2 supplied to the 14$^{th}$ input terminal 1104.

In the meantime, in FIG. 6, it has been described that the 11$^{th}$ transistors M11_1 and M11_2, the 16$^{th}$ transistors M16_1 and M16_2, and the 17$^{th}$ transistors M17_1 and M17_2 are formed of a plurality of transistors, but the present invention is not limited thereto. For example, each of the 11$^{th}$ transistors M11_1 and M11_2, the 16$^{th}$ transistors M16_1 and M16_2, and the 17$^{th}$ transistors M17_1 and M17_2 may be configured in a manner that one or more transistors are serially connected.

Further, each of the stages ST1 to STn is formed in the same structure as that described with reference to FIG. 6. However, the signals supplied to the respective input terminals are changed in response to the location as illustrated in FIG. 2.

Figure 7:
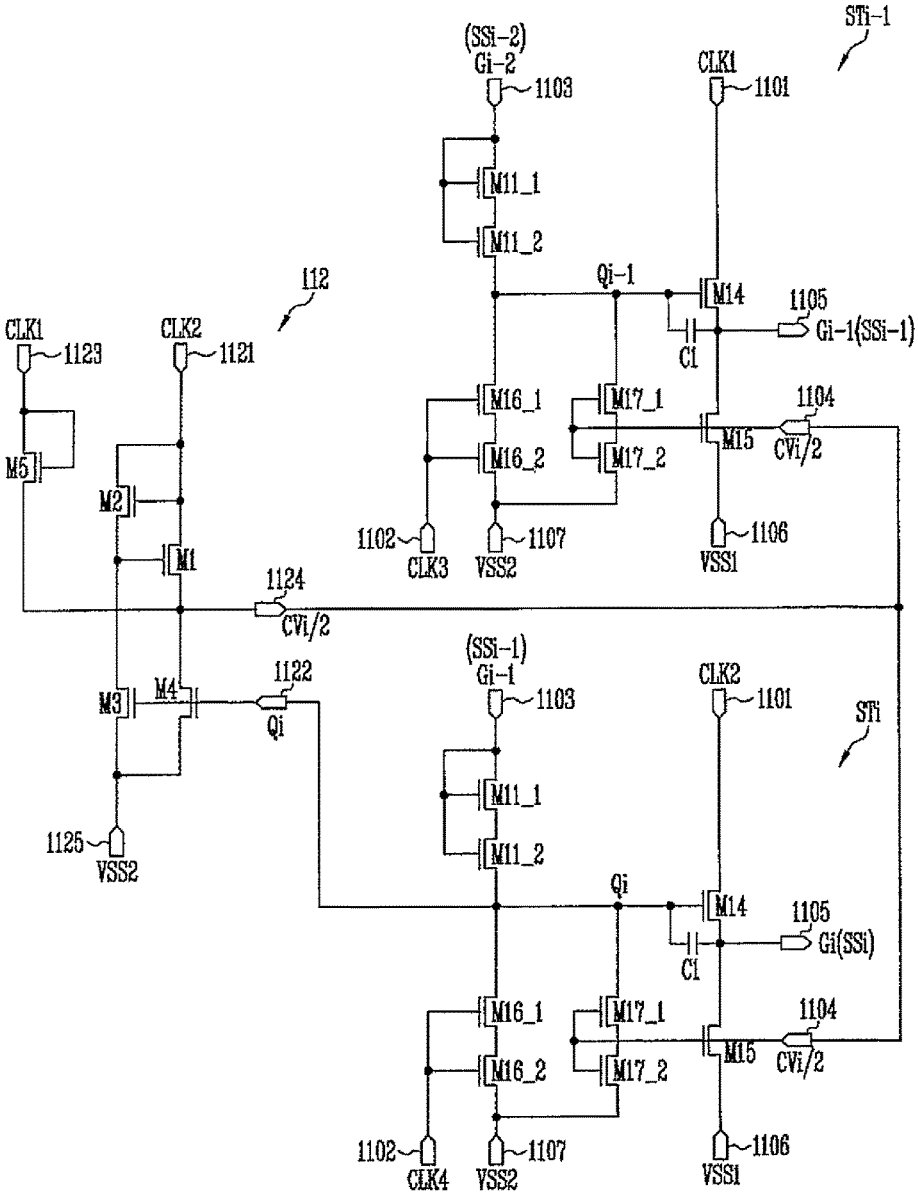
FIG. 7 is a diagram illustrating an example embodiment of a connection configuration of an $i-1^{th}$ stage, an $i^{th}$ stage, and the controller.

FIG. 7 is a diagram illustrating an example embodiment of a connection configuration of the i−1$^{th}$ stage, the i$^{th}$ stage, and the controller. FIG. 8 is a diagram illustrating an example embodiment of an operation process of FIG. 7. In order to describe an operation process of FIG. 7, terminals and transistors included in the i−1$^{th}$ stage STi−1 are denoted with a term "first", and terminals and transistors included in the i$^{th}$ stage STi are denoted with a term "second".

Referring to FIGS. 7 and 8, first, the third clock signal CLK3 is supplied to the first 12$^{th}$ input terminal 1102 for a first period T1. When the third clock signal CLK3 is supplied to the first 12$^{th}$ input terminal 1102, the first 16$^{th}$ transistors M16_1 and M16_2 are turned on. When the first 16$^{th}$ transistors M16_1 and M16_2 are turned on, the second off voltage VSS2 from the second power input terminal 1107 is supplied to the node Qi−1, and thus the first 14$^{th}$ transistor M4 is turned off.

For a second period T2, a fourth clock signal CLK4 is supplied to the second 12$^{th}$ input terminal 1102. When the fourth clock signal CLK4 is supplied to the second 12$^{th}$ input terminal 1102, the second 16$^{th}$ transistors M16_1 and M16_2 are turned on. When the second 16$^{th}$ transistors M16_1 and M16_2 are turned on, the second off voltage VSS2 from the second power input terminal 1107 is supplied to the node Qi, and thus the second 14$^{th}$ transistor M4 is turned off.

Further, during the second period T2, the i−2$^{th}$ scan signal SSi−2 of the i−2$^{th}$ stage STi−2 is supplied to the first 13$^{th}$ input terminal 1103. When the i−2$^{th}$ scan signal SSi−2 is supplied to the 13$^{th}$ input terminal 1103, the first 11$^{th}$ transistors M11_1 and M11-2 are turned on, and thus the voltage of the node Qi−1 is increased to the gate-on voltage. When the voltage of the node Qi−1 is increased to the gate-on voltage, the first 14$^{th}$ transistor M14 is turned on, and thus, the first 11$^{th}$ input terminal 1101 and the first second output terminal 1105 are electrically connected. For the second period T2, the first first capacitor C1 stores the voltage corresponding to the node Qi−1.

For a third period T3, the first clock signal CLK1 is supplied to the first 11$^{th}$ input terminal 1101. In this case, because the first 14$^{th}$ transistor M14 is set to be in a turn-on state, the first clock signal CLK1 supplied to the first 11$^{th}$ input terminal 1101 is supplied to the first second output terminal 1105. Here, the first clock signal CLK1 supplied to the first second output terminal 1105 is supplied to the i−1$^{th}$ scan line Si−1 as the i−1$^{th}$ scan signal SSi−1. In additional, when the i−1$^{th}$ scan signal SSi−1 is supplied to the first second output terminal 1105, the voltage of the node Qi−1 is increased by boosting of the first capacitor C1, and thus, the first 14$^{th}$ transistor M14 stably maintains the turn-on state.

In the meantime, the i−1$^{th}$ scan signal SSi−1 supplied to the first second output terminal 1105 is supplied to the second 13$^{th}$ input terminal 1103. When the i−1$^{th}$ scan signal SSi−1 is supplied to the second 13$^{th}$ input terminal 1103, the second 11$^{th}$ transistors M11_1 and M11-2 are turned on, and thus the voltage of the node Qi is increased to the gate-on voltage. When the voltage of the node Qi is increased to the gate-on voltage, the second 14$^{th}$ transistor M14 is turned on, and thus, the second 11$^{th}$ input terminal 1101 and the second second output terminal 1105 are electrically connected. Further, for the third period T3, the second first capacitor C1 stores the voltage corresponding to the node Qi.

In the meantime, when the voltage of the node Qi is increased to the gate-on voltage, the third transistor M3 and the fourth transistor M4 included in the controller 112 are turned on. When the third transistor M3 is turned on, the second off voltage VSS2 is supplied to the gate electrode of the first transistor M1, and thus, the first transistor M1 is turned off. When the fourth transistor M4 is turned on, the second off voltage VSS2 is supplied to the first output terminal 1124. When the second off voltage VSS2 is supplied to the first output terminal 1124, the first 15$^{th}$ transistor M15, the first 17$^{th}$ transistors M17_1 and M17_2, the second 15$^{th}$ transistor M15, and the second 17$^{th}$ transistors M17_1 and M17_2 are set in the turn-off state.

Additionally, for the third period T3, the first clock signal CLK1 is supplied to the third input terminal 1123. When the first clock signal CLK1 is supplied to the third input terminal 1123, the fifth transistor M5 is turned on. In this case, because the fifth transistor M5 is connected in a form of a diode, when it is assumed that channel widths of the fifth transistor M5 and the fourth transistor M4 are similar to each other, the first output terminal 1124 maintains the voltage of the second off voltage VSS2.

For a fourth period T4, the second clock signal CLK2 is supplied to the second $11^{th}$ input terminal 1101. In this case, because the second $14^{th}$ transistor M14 is set to be in a turn-on state, the second clock signal CLK2 supplied to the second $11^{th}$ input terminal 1101 is supplied to the second second output terminal 1105. Here, the second clock signal CLK2 supplied to the second second output terminal 1105 is supplied to the $i^{th}$ scan line Si as the $i^{th}$ scan signal SSi. Additionally, the voltage of the node Qi is increased by the second first capacitor C1 for the fourth period T4, and thus the second $14^{th}$ transistor M14 stably maintains the turn-on state.

Further, the third transistor M3 and the fourth transistor M4 maintains the turn-on state in response to the voltage of the node Qi for the fourth period T4. Then, the second off voltage VSS2 is supplied to the first output terminal 1124. When the second off voltage VSS2 is supplied to the first output terminal 1124, the first $15^{th}$ transistor M15, the first $17^{th}$ transistors M17_1 and M17_2, the second $15^{th}$ transistor M15, and the second $17^{th}$ transistors M17_1 and M17_2 are set in the turn-off state.

Additionally, for the fourth period T4, the second clock signal CLK2 is supplied to the first input terminal 1121. When the first clock signal CLK1 is supplied to the first input terminal 1121, the second transistor M2 connected in the form of the diode is turned on. In this case, because the third transistor M3 directly receives the voltage of the node Qi, when it is assumed that channel widths of the second transistor M2 and the third transistor M3 are similar to each other, the second off voltage VSS2 is supplied to the gate electrode of the first transistor M1. Accordingly, for the fourth period T4, the first transistor M1 is set to be in the turn-off state, and thus, the first input terminal 1124 maintains the voltage of the second off voltage VSS2.

For a fifth period T5, the third clock signal CLK3 is supplied to the first $12^{th}$ input terminal 1101. When the third clock signal CLK3 is supplied to the first $12^{th}$ input terminal 1102, the first $16^{th}$ transistors M16_1 and M16_2 are turned on. When the first $16^{th}$ transistors M16_1 and M16_2 are turned on, the second off voltage VSS2 from the second power input terminal 1107 is supplied to the node Qi−1, and thus the first $14^{th}$ transistor M4 is turned off.

For a sixth period T6, the fourth clock signal CLK4 is supplied to the second $12^{th}$ input terminal 1102. When the fourth clock signal CLK4 is supplied to the second $12^{th}$ input terminal 1102, the second $16^{th}$ transistors M16_1 and M16_2 are turned on. When the second $16^{th}$ transistors M16_1 and M16_2 are turned on, the second off voltage VSS2 from the second power input terminal 1107 is supplied to the node Qi, and thus the second $14^{th}$ transistor M4 is turned off.

Then, for a seventh period T7, the first clock signal CLK1 and the second clock signal CLK2 are sequentially supplied.

The first clock signal CLK1 supplied for the seventh period T7 is supplied to the first $11^{th}$ input terminal 1101 and the third input terminal 1123.

When the first clock signal CLK1 is supplied to the first $11^{th}$ input terminal 1101, the first $14^{th}$ transistor M14 is set in the turn-off state. Accordingly, the scan signal SSi−1 is not supplied to the first second output terminal 1105.

When the first clock signal CLK1 is supplied to the third input terminal 1123, the fifth transistor M5 is turned on. When the fifth transistor M5 is turned on, the first clock signal CLK1 is supplied to the first output terminal 1124. When the first clock signal CLK1 is supplied to the first output terminal 1124, the first $15^{th}$ transistor M15, the first $17^{th}$ transistors M17_1 and M17_2, the second $15^{th}$ transistor M15, and the second $17^{th}$ transistors M17_1 and M17_2 are turned on.

When the first $15^{th}$ transistor M15 is turned on, the first off voltage VSS1 is supplied to the first second output terminal 1105. When the first $17^{th}$ transistors M17_1 and M17_2 are turned on, the second off voltage VSS2 is supplied to the node Qi−1. In this case, because the second off voltage VSS2 is set to be a voltage lower than the first off voltage VSS1, the first $14^{th}$ transistor M14 is completely turned off, and thus, a leakage current is minimized or reduced, thereby improving power consumption.

When the second $15^{th}$ transistor M15 is turned on, the first off voltage VSS1 is supplied to the second second output terminal 1105. When the second $17^{th}$ transistors M17_1 and M17_2 are turned on, the second off voltage VSS2 is supplied to the node Qi. In this case, because the second off voltage VSS2 is set to be a voltage lower than the first off voltage VSS1, the second fourth transistor M14 is completely turned off, and thus, a leakage current is minimized or reduced, thereby improving power consumption.

The second clock signal CLK2 supplied for the seventh period T7 is supplied to the second $11^{th}$ input terminal 1101 and the first input terminal 1121.

When the second clock signal CLK2 is supplied to the second $11^{th}$ input terminal 1101, the second $14^{th}$ transistor M14 is set in the turn-off state. Accordingly, the scan signal SSi is not supplied to the second second output terminal 1105.

When the second clock signal CLK2 is supplied to the first input terminal 1121, the second transistor M2 is turned on. When the second transistor M2 is turned on, the second clock signal CLK2 is supplied to the gate electrode of the first transistor M1, and thus the first transistor M1 is turned on. When the first transistor M1 is turned on, the second clock signal CLK2 to the first input terminal 1121 is supplied to the first output terminal 1124. When the second clock signal CLK2 is supplied to the first output terminal 1124, the first $15^{th}$ transistor M15, the first $17^{th}$ transistors M17_1 and M17_2, the second $15^{th}$ transistor M15, and the second $17^{th}$ transistors M17_1 and M17_2 are turned on.

When the first $15^{th}$ transistor M15 is turned on, the first off voltage VSS1 is supplied to the first second output terminal 1105. When the first $17^{th}$ transistors M17_1 and M17_2 are turned on, the second off voltage VSS2 is supplied to the node Qi−1. In this case, because e the second off voltage VSS2 is set to be a voltage lower than the first off voltage VSS1, the first $14^{th}$ transistor M14 is completely turned off, and thus, a leakage current is minimized or reduced, thereby improving power consumption.

When the second $15^{th}$ transistor M15 is turned on, the first off voltage VSS1 is supplied to the second second output terminal 1105. When the second $17^{th}$ transistors M17_1 and M17_2 are turned on, the second off voltage VSS2 is supplied to the node Qi. In this case, because the second off voltage VSS2 is set to be a voltage lower than the first off voltage VSS1, the second fourth transistor M14 is completely turned off, and thus, a leakage current is minimized or reduced, thereby improving power consumption.

In the meantime, the $i+1^{th}$ stage STi+1 outputs the $i+1^{th}$ scan signal SSi+1 by using the third clock signal CLK3, and the $i+2^{th}$ stage STi+2 outputs the $i+2^{th}$ scan signal SSi+2 by using the fourth clock signal CLK4. Actually, the stages of the present invention may sequentially output the scan signal to the scan lines S1 to Sn while repeating the aforementioned process.

Figure 9:
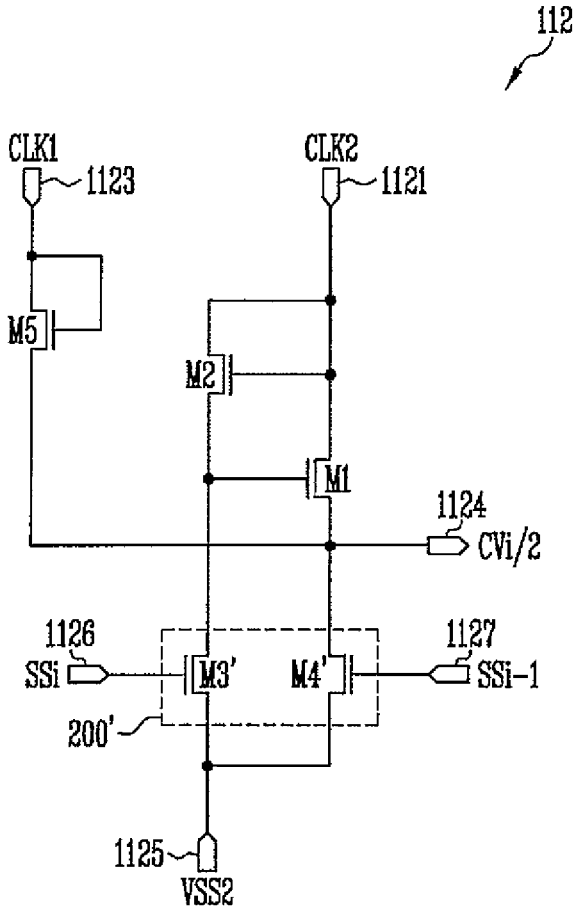
FIG. 9 is a diagram illustrating another example embodiment of the controller illustrated in FIG. 3.

FIG. 9 is a diagram illustrating another example embodiment of the controller illustrated in FIG. 3. In describing FIG. 9, the same configuration as that of FIG. 5 is denoted with the same reference numeral, so that a detailed description thereof will be omitted.

Referring to FIG. 9, the controller 112 according to another example embodiment of the present invention includes a first transistor M1, a second transistor M2, a fifth transistor M5, and a first driver 200'.

To this end, the first driver 200' includes a third transistor M3' and a fourth transistor M4'.

The third transistor M3' is connected between a gate electrode of the first transistor M1 and a second power input terminal 1125. Further, a gate electrode of the third transistor M3' is connected to a fourth input terminal 1126. The third transistor M3' is turned on when an $i^{th}$ scan signal SSi is supplied to the fourth input terminal 1126, and supplies a second off voltage VSS2 to the gate electrode of the first transistor M1.

The fourth transistor M4' is connected between the first output terminal 1124 and the second power input terminal 1125. Further, a gate electrode of the fourth transistor M4' is connected to the fifth input terminal 1127. The fourth transistor M4' is turned on when an $i-1^{th}$ scan signal SSi−1 is supplied to the fifth input terminal 1127, and supplies the second off voltage VSS2 to the first output terminal 1124.

The controller 112 according to another example embodiment of the present invention has the same substantial operation process as that of the controller 112 of FIG. 5 except for the change of the signal supplied to the gate electrodes of the third transistor M3' and the fourth transistor M4'. Accordingly, a description of the detailed operation process will be described.

Figure 10:
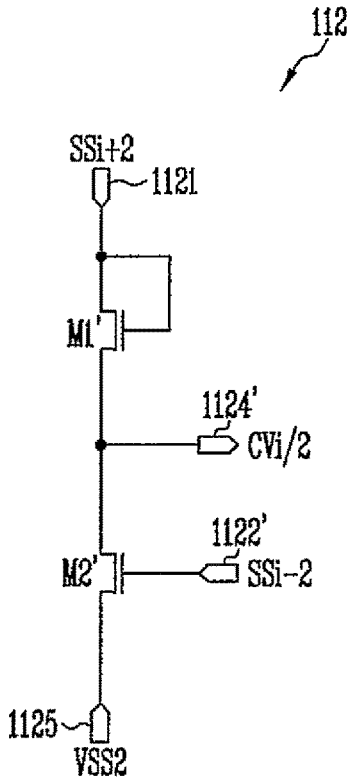
FIG. 10 is a diagram illustrating still another example embodiment of the controller illustrated in FIG. 3.

FIG. 10 is a diagram illustrating still another example embodiment of the controller illustrated in FIG. 3.

Referring to FIG. 10, the controller 112 according to another example embodiment of the present invention includes a first transistor M1' and a second transistor M2'.

The first transistor M1' is connected between a first input terminal 1121' and a first output terminal 1124'. Further, a gate electrode of the first transistor M1' is connected to the first input terminal 1121'. The first transistor M1' is turned on when an $i+2^{th}$ scan signal SSi+2 is supplied to the first input terminal 1121'.

The second transistor M2' is connected between the first output terminal 1124' and the second power input terminal 1125. Further, a gate electrode of the second transistor M2' is connected to a second input terminal 1122'. The second transistor M2' is turned on when an $i-2^{th}$ scan signal SSi−2 is supplied to the second input terminal 1122'.

Figure 11:
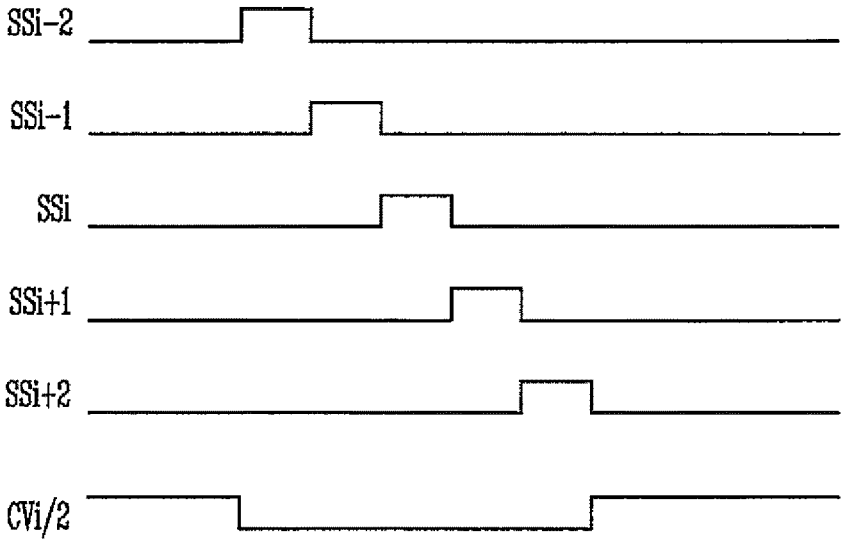
FIG. 11 is a waveform diagram illustrating an operation process of the controller illustrated in FIG. 10.

FIG. 11 is a waveform diagram illustrating an operation process of the control unit illustrated in FIG. 10.

Referring to FIG. 11, first, the $i-2^{th}$ scan signal SSi−2 is supplied to the second input terminal 1122', so that the second transistor M2' is turned on. When the second transistor M2' is turned on, the second off voltage VSS2 from the second power input terminal 1125 is supplied to the first output terminal 1124'. The second off voltage VSS2 supplied to the first output terminal 1124' maintains the voltage until the first transistor M1' is turned on.

Then, the $i+2^{th}$ scan signal SSi+2 is supplied to the first input terminal 1121', so that the first transistor M1' is turned on. When the first transistor M1' is turned on, the voltage of the $i+2^{th}$ scan signal SSi+2, that is, a gate-on voltage, is supplied to the first output terminal 1124'.

The controller 112 according to another example embodiment of the present invention maintains a control voltage CVi/2 of the first output terminal 1124' as the second off voltage VSS2 during a period of the output of the scan signals SSi−1 and SSi from the $i-1^{th}$ stage STi−1 and the $i^{th}$ stage STi, and maintains the gate-on voltage during other periods. Then, the $i-1^{th}$ stage STi−1 and the $i^{th}$ stage STi may stably output the scan signals SSi−1 and SSi.

Figure 12:
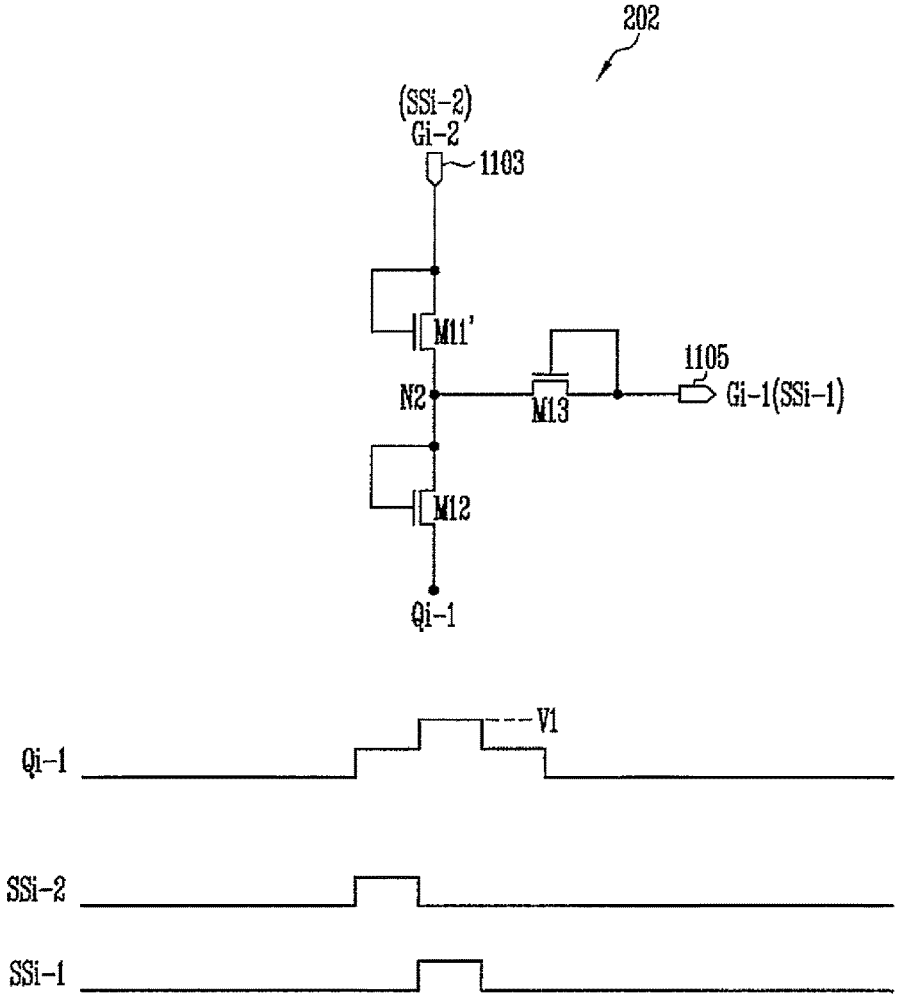
FIG. 12 is a diagram illustrating another example embodiment of a pull-up unit illustrated in FIG. 6.

FIG. 12 is a diagram illustrating another example embodiment of a pull-up unit illustrated in FIG. 6.

Referring to FIG. 12, the pull-up unit 202 according to another example embodiment of the present invention includes an $11^{th}$ transistor M11', a $12^{th}$ transistor M12, and a $13^{th}$ transistor M13.

The $11^{th}$ transistor M11' is connected between a $13^{th}$ input terminal 1103 and a second node N2. Further, a gate electrode of the $11^{th}$ transistor M11' is connected to the $13^{th}$ input terminal 1103. The $11^{th}$ transistor M11' is turned on when an $i-2^{th}$ scan signal SSi−2 is supplied to the $13^{th}$ input terminal 1103.

The $12^{th}$ transistor M12 is connected between the second node N2 and the node Qi−1. Then, a gate electrode of the $12^{th}$ transistor M12 is connected to the second node N2. The $12^{th}$ transistor M12 is turned on or turned off in response to a voltage of the second node N2.

The $13^{th}$ transistor M13 is connected between the second node N2 and a second output terminal 1105. Further, a gate electrode of the $13^{th}$ transistor M13 is connected to the second output terminal 1105. The third transistor M13 is turned on when an $i-1^{th}$ scan signal SSi−1 is supplied to the second output terminal 1105.

In describing the operation process, when the $i-2^{th}$ scan signal SSi−2 is supplied, the $11^{th}$ transistor M11' is turned on. When the $11^{th}$ transistor M11' is turned on, a voltage of the $i-2^{th}$ scan signal SSi−2 is supplied to the second node N2. When the voltage of the $i-2^{th}$ scan signal SSi−2 is supplied to the second node N2, the $12^{th}$ transistor M12 is turned on. Then, the voltage of the $i-2^{th}$ scan signal, that is, the gate-on voltage, is supplied to the node Qi−1.

Then, the $13^{th}$ transistor M13 is turned on by the $i-1^{th}$ scan signal SSi−1 supplied to the second output terminal 1105. When the $13^{th}$ transistor M13 is turned on, a voltage of the $i-1^{th}$ scan signal SSi−1 is supplied to the second node N2.

In the meantime, the $13^{th}$ input terminal 1103 is set as the off voltage, the second node N2 is set as the voltage of the $i-1^{th}$ scan signal SSi−1, and the node Qi−1 is set as a first voltage V1 higher than the $i-1^{th}$ scan signal SSi−1 in response to boosting of the first capacitor C1 at a time at which the $i-1^{th}$ scan signal SSi−1 is supplied.

In this case, a voltage difference between the off voltage and the $i-1^{th}$ scan signal SSi−1 is applied to the $11^{th}$ transistor M11' and a voltage difference between the $i-1^{th}$ scan signal SSi−1 and the first voltage V1 is applied to the $12^{th}$ transistor M12. Then, deterioration of the $11^{th}$ transistor M11' and the $12^{th}$ transistor M12 is minimized or reduced, thereby capable of securing reliable driving.

That is, the $11^{th}$ transistors M11_1 and M11_2 illustrated in FIG. 6 receive the voltage corresponding to the voltage difference between the first voltage V1 and the off voltage while the node Qi−1 is set as the first voltage V1. Then, the voltage difference between the both ends of the $11^{th}$ transistors M11_1 and M11-2 is set to about 35 V or more, and thus, the $11^{th}$ transistors M11_1 and M11-2 may easily deteriorate.

In contrast to this, a voltage difference between both ends of each of the $11^{th}$ transistor M11' and the $12^{th}$ transistor M12 illustrated in FIG. 12 are set to 30 V or lower while the node Qi−1 is set as the first voltage V1, thereby minimizing or reducing deterioration of the $11^{th}$ transistor M11' and the $12^{th}$ transistor M12.

Figure 13:
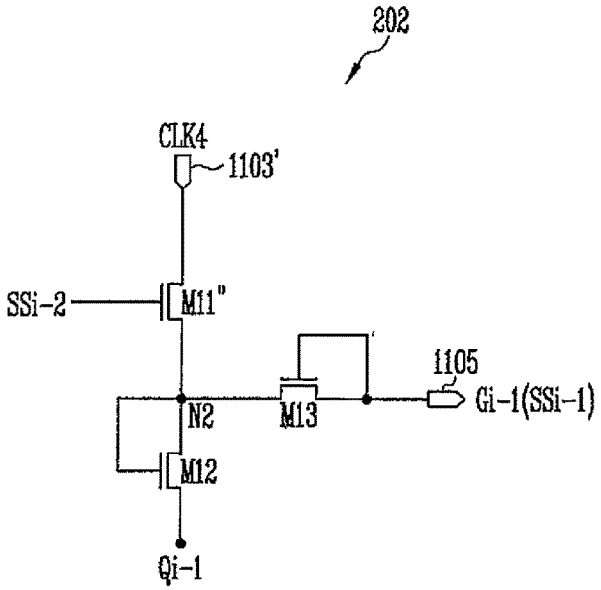
FIG. 13 is a diagram illustrating another example embodiment of the pull-up unit illustrated in FIG. 6.
Figure 13:
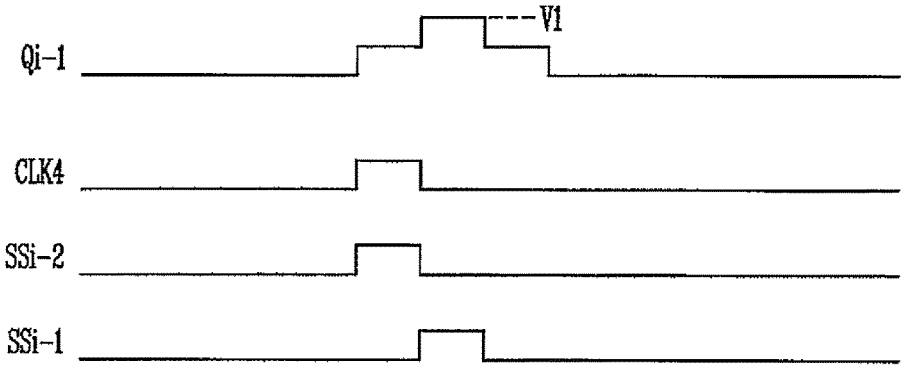

FIG. 13 is a diagram illustrating another example embodiment of the pull-up unit illustrated in FIG. 6. In describing FIG. 13, the same configuration as that of FIG. 12 is denoted with the same reference numeral, so that a detailed description thereof will be omitted.

Referring to FIG. 13, the pull-up unit 202 according to another example embodiment of the present invention includes an $11^{th}$ transistor M11", a $12^{th}$ transistor M12, and a $13^{th}$ transistor M13.

The $11^{th}$ transistor M11" is connected between a $13^{th}$ input terminal 1103' and a second node N2. The $11^{th}$ transistor M11" is turned on when an $i-2^{th}$ scan signal SSi−2 is supplied and supplies a fourth clock signal CLK4 from the $13^{th}$ input terminal 1103' to the second node N2.

That is, the fourth clock signal CLK4 is supplied to the $13^{th}$ input terminal 1103' located in an $i-1^{th}$ stage STi−1 (that is, supplies a first clock signal to an $11^{th}$ input terminal). Then, the first clock signal CLK1 is supplied to the $13^{th}$ input terminal 1103' located in an $i^{th}$ stage STi (that is, supplies a second clock signal to the $11^{th}$ input terminal).

The substantial operation process of the pull-up unit 202 according to another example embodiment of the present invention is the same as that of FIG. 12 except for the change of the signal input to the $11^{th}$ transistor M11". Accordingly, a description of the detailed operating process will be described.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. A scan driver comprising a plurality of stages configured to supply scan signals to scan lines, the scan driver comprising:

a plurality of stages, each connected to a corresponding scan line;

an $i-1^{th}$ stage from among the plurality of stages and configured to supply an $i-1^{th}$ scan signal to an $i-1^{th}$ scan line while controlling a node Qi−1 (i is a natural number) in response to a first clock signal, a third clock signal, and a control voltage;

an $i^{th}$ stage from among the plurality of stages and configured to supply an $i^{th}$ scan signal to an $i^{th}$ scan line while controlling a node Qi in response to a second clock signal, a fourth clock signal, and the control voltage; and a plurality of controllers each having an output terminal connected to two adjacent stages from among the plurality of stages to supply corresponding control voltages to the two adjacent stages, wherein a first controller is connected to the $i-1^{th}$ stage and the $i^{th}$ stage, and configured to supply the control voltage, wherein the first controller comprises:

a first transistor between a first input terminal configured to receive the second clock signal is supplied, and a first output terminal configured to output the control voltage;

a second transistor between a gate electrode of the first transistor and the first input terminal, and comprising a gate electrode connected to the first input terminal; and a first driver configured to control a voltage of the first output terminal in response to a voltage supplied from at least one of the i−1th stage or the ith stage, and wherein the first driver comprises:

a third transistor between the gate electrode of the first transistor and a second power input terminal configured to receive a second off voltage, and comprising a gate electrode connected to a second input terminal electrically connected with the node Qi; and a fourth transistor between the first output terminal and the second power input terminal, and comprising a gate electrode connected to the second input terminal.

2. The scan driver of claim 1, wherein the first clock signal to the fourth clock signal are sequentially supplied so that high sections thereof do not overlap each other.

3. The scan driver of claim 1, wherein the first driver further comprises a fifth transistor between the first output terminal and a third input terminal to which the first clock signal is supplied, and comprises a gate electrode connected to the third input terminal.

4. A scan driver comprising a plurality of stages configured to supply scan signals to scan lines, the scan driver comprising:

a plurality of stages, each connected to a corresponding scan line;

an i−1th stage from among the plurality of stages and configured to supply an i−1th scan signal to an i−1th scan line while controlling a node Qi−1 (i is a natural number) in response to a first clock signal, a third clock signal, and a control voltage;

an ith stage from among the plurality of stages and configured to supply an ith scan signal to an ith scan line while controlling a node Qi in response to a second clock signal, a fourth clock signal, and the control voltage; and a plurality of controllers each having an output terminal connected to two adjacent stages from among the plurality of stages to supply corresponding control voltages to the two adjacent stages, wherein a first controller is connected to the i−1th stage and the ith stage, and configured to supply the control voltage, wherein each of the $i-1^{th}$ stage and the $i^{th}$ stage comprises:

an output unit located between an $11^{th}$ input terminal and a first power input terminal configured to receive a first off voltage, and the output unit being configured to supply a scan signal to a second output terminal in response to a voltage of a first node and a 14th input terminal configured to receive the control voltage;

a pull-down unit connected to an $12^{th}$ input terminal and a second power input terminal configured to receive a second off voltage and configured to control a voltage of the first node;

a pull-up unit between a $13^{th}$ input terminal and the first node, and configured to control a voltage of the first node; and a second driver connected to the first node, the second power input terminal, and the $14^{th}$ input terminal and configured to control a voltage of the first node.

5. The scan driver of claim 4, wherein the first off voltage and a second off voltage are set to a same voltage.

6. The scan driver of claim 4, wherein the second off voltage is set to a voltage lower than the first off voltage.

7. The scan driver of claim 4, wherein the first clock signal is supplied to an $11^{th}$ input terminal of the $i-1^{th}$ stage, the third clock signal is supplied to a $12^{th}$ input terminal of the $i-1^{th}$ stage, and an $i-2^{th}$ scan signal that is an output signal of a stage of a previous terminal is supplied to a $13^{th}$ input terminal of the $i-1_{th}$ stage, and the first node of the $i-1^{th}$ stage is the node Qi−1.

8. The scan driver of claim 4, wherein the second clock signal is supplied to an $11^{th}$ input terminal of the $i^{th}$ stage, the fourth clock signal is supplied to a $12^{th}$ input terminal of the $i^{th}$ stage, and an $i-1^{th}$ scan signal that is an output signal of a stage of a previous terminal is supplied to a $13^{th}$ input terminal of the $i^{th}$ stage, and the first node of the $i^{th}$ stage is the node Qi.

9. The scan driver of claim 4, wherein the pull-up unit comprises one or more $11^{th}$ transistors connected to the $13^{th}$ input terminal and the first node and comprise gate electrodes connected to the $13^{th}$ input terminal.

10. The scan driver of claim 4, wherein the pull-up unit comprises:

an $11^{th}$ transistor between the $13^{th}$ input terminal and a second node, and comprising a gate electrode connected to the $13^{th}$ input terminal;

a $12^{th}$ transistor between the second node and the first node, and comprising a gate electrode connected to the second node; and a $13^{th}$ transistor between the second node and the second output terminal, and comprising a gate electrode connected to the second output terminal.

11. The scan driver of claim 4, wherein the pull-up unit comprises:

an $11^{th}$ transistor between the $13^{th}$ input terminal and a second node, and turned on when an $i-2^{th}$ scan signal is supplied;

a $12^{th}$ transistor between the second node and the first node, and comprising a gate electrode connected to the second node; and a $13^{th}$ transistor between the second node and the second output terminal, and comprising a gate electrode connected to the second output terminal.

12. The scan driver of claim 11, wherein when the first clock signal is supplied to the 11th input terminal, the fourth clock signal is supplied to the 13th input terminal, and when the second clock signal is supplied to the 11th input terminal, the first clock signal is supplied to the 13th input terminal.

13. The scan driver of claim 4, wherein the output unit comprises:

a $14^{th}$ transistor between the $11^{th}$ input terminal and the second output terminal, and comprising a gate electrode connected to the first node;

a $15^{th}$ transistor between the second output terminal and the first power input terminal, and comprising a gate electrode connected to the $14^{th}$ input terminal; and a first capacitor between the first node and the second output terminal.

14. The scan driver of claim 4, wherein the pull-down unit comprises one or more $16^{th}$ transistors which are serially connected between the first node and the second power input terminal and include gate electrodes connected to the $12^{th}$ input terminal.

15. The scan driver of claim 4, wherein the second driver comprises one or more $17^{th}$ transistors between the first node and the second power input terminal and comprise gate electrodes connected to the $14^{th}$ input terminal.

* * * * *